US005284336A

United States Patent [19]

Ricciardi

[11] Patent Number: 5,284,336

[45] Date of Patent: Feb. 8, 1994

[54] SLIDABLE, LOWERABLE, AND REMOVABLE BIN TRAY

[75] Inventor: Mario Ricciardi, Glenview, Ill.

[73] Assignee: Bell & Howell Phillipsburg Company, Evanston, Ill.

[21] Appl. No.: 935,777

[22] Filed: Aug. 28, 1992

[51] Int. Cl.[5] ..... B65H 31/00

[52] U.S. Cl. ..... 271/213

[58] Field of Search ..... 271/207, 213, 214, 215

[56] References Cited

U.S. PATENT DOCUMENTS 4,423,995 1/1984 Karis ..... 271/213 X 4,984,780 1/1991 Saito ..... 271/213 X

*Primary Examiner*—Richard A. Schacher

*Attorney, Agent, or Firm*—Millen, White, Zelano & Branigan

[57] ABSTRACT

A bin tray is provided for supporting a mail bin which receives documents from a document processing machine. The bin tray is slidable so that it may be stored underneath the table when not in use and is lowerable and removable so as to facilitate access to the underside of the document processing machine. This is accomplished by use of a tray assembly which is removably and rotably attached to two support rods running underneath the table in a direction perpendicular to the feeding direction of the documents as they enter the bin. The support rods are generally vertically oriented with respect to each other and provide support for a housing containing a slidable bin tray.

14 Claims, 2 Drawing Sheets

SLIDABLE, LOWERABLE, AND REMOVABLE BIN TRAY

BACKGROUND OF THE INVENTION

1. Field of the Invention

The invention relates to document handling machines, and particularly to document handling machines which include a diverter table wherein the output of the machine is fed to at least one receiving bin.

2. Related Art

Document handling machines which perform an operation, such as sorting, labeling, or inserting, on a stream of documents are well-known. Such machines often use a diverter table which diverts each item to one of a row of bins. The bins rest freely on trays extending outside the periphery of the table and the bins are lifted and removed when they have accumulated a number of documents. When one bin station is not in use, however, the bin trays present an obstruction to persons inspecting and repairing the table and components which are located on the underside of the table.

SUMMARY

It is an object of the present invention to solve the above problems by providing a bin tray which is slidable so that it may be stored underneath the table when not in use and which is lowerable and removable so as to facilitate access to the underside of the table. This is accomplished by use of a tray assembly which is rotatably and removably attached to two crossbars, each extending underneath the table in a direction perpendicular to the feeding direction of the documents as they enter the receiving bin. The crossbars are vertically oriented with respect to each other and provide support for a housing containing a slidable bin tray.

BRIEF DESCRIPTION OF THE DRAWINGS

The foregoing and other objects, features, and advantages of the invention will be apparent from the following more particular description of the preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
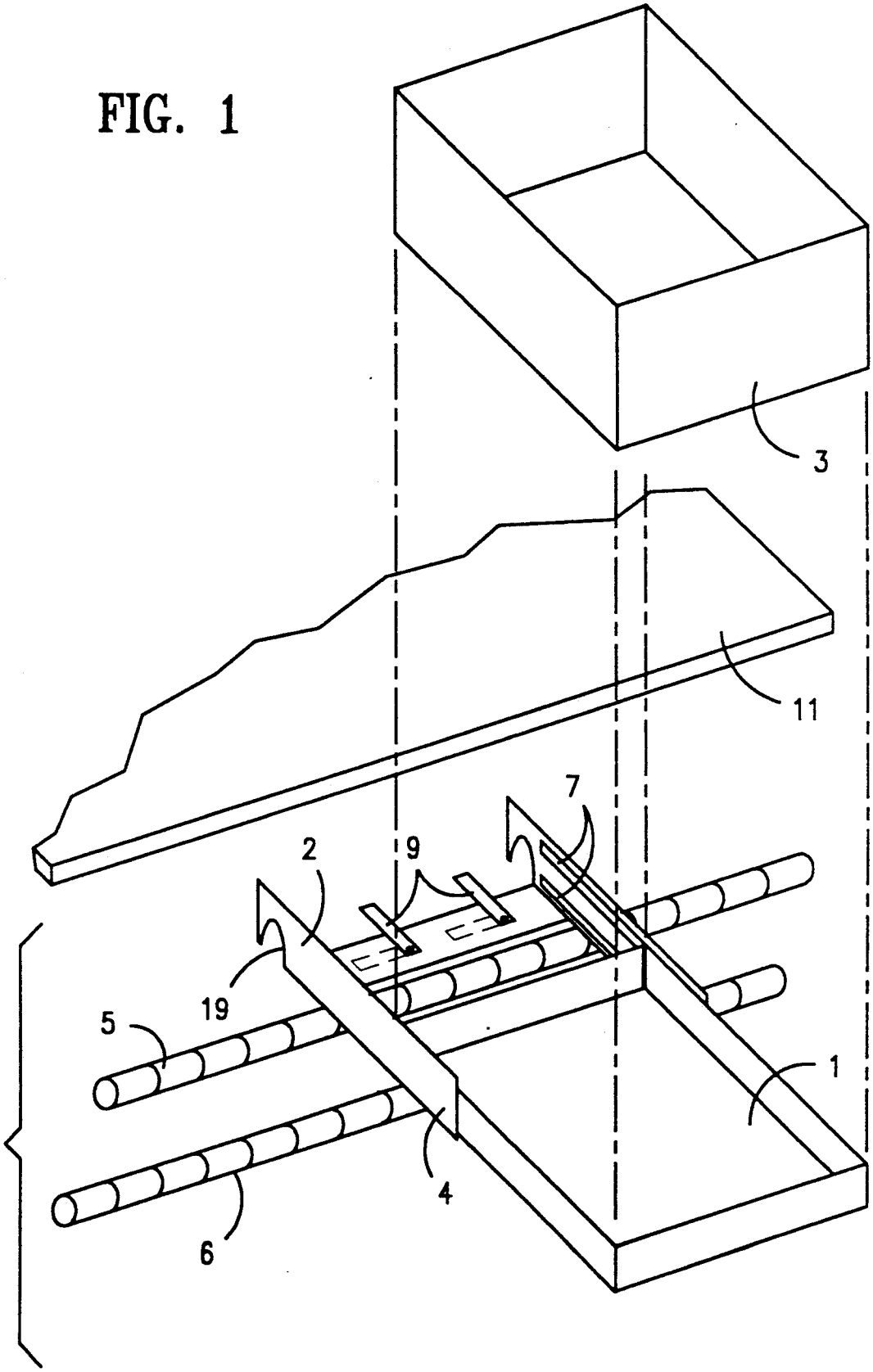
FIG. 1 is a perspective view showing basic elements of the present invention.

As shown in FIG. 1, support for a receiving bin 3 is provided by a tray assembly 8 comprising a slidable bin tray 1 which slides on a slide means into housing 4. The slide means may comprise a set of tracks 7 in which a set of rails 25, FIG. 2, slides, or other known slide mechanism. Support for housing 4 is provided by upper and lower support rods 5, 6, which run underneath the table in a direction perpendicular to the feeding direction of the documents 17 as they are fed from the side of the table 11 in FIG. 2. Housing 4 rests upon upper support rod 5 by means of notch 19, which is shaped so as to accept upper support rod 5. As shown, upper support rod 5 is cylindrical and notch 19 is crescent shaped.

However, other shapes, such as rectangular, are possible for those components.

Figure 2:
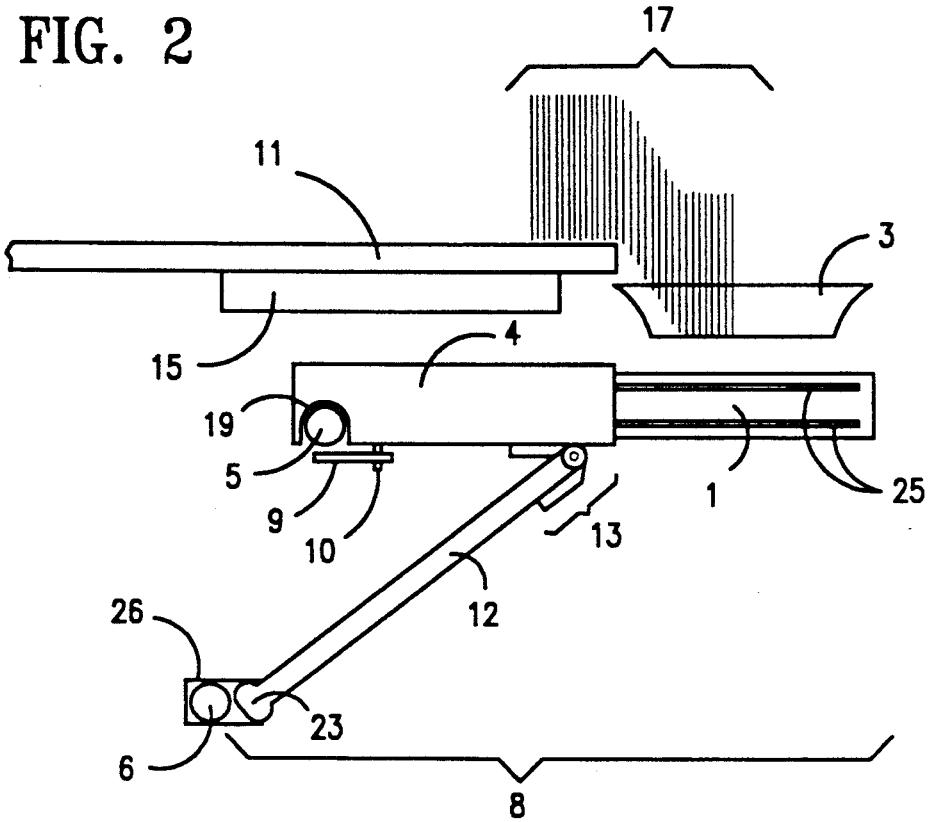
FIG. 2 is a side view showing the tray assembly in an upright, open position.

As shown in FIG. 2, when tray assembly 8 is in an upright and "open" position, slidable bin tray 1 extends beyond the edge of table top 11 and supports receiving bin 3 for receiving documents 17 as they exit from table top 11. Rails 25 allow the bin tray to slide along track 7, FIG. 1. Table top 11 may hold a diverter or other sorting or processing equipment which feeds documents for take-away in bins.

Support leg 12 swings freely on hinge 13 and, as shown in FIG. 2, is swung to a supporting position in which knob 23 is fit into brace 26 attached to lower support rod 6. Retaining tabs 9, which rotate on axle 10, are shown in a closed position in which they prevent pivoting of tray assembly 8 about hinge 13 when weight is placed on bin tray 1. Slidable bin tray 1 can be recessed into housing 4 for storage when not in use.

Figure 3:
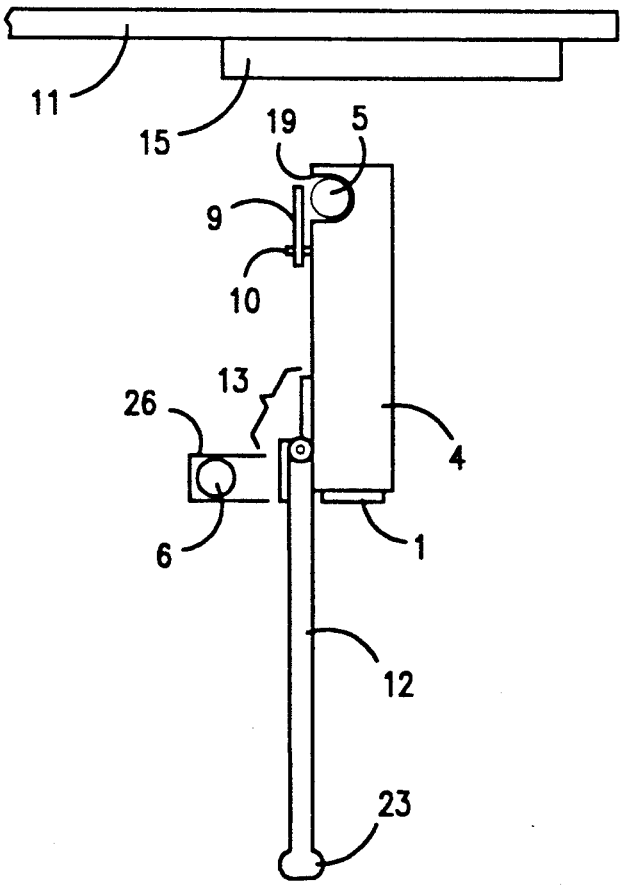
FIG. 3 is a side view showing the tray assembly in a lowered, closed position.

As shown in FIG. 3, tray assembly 8 can be placed in a "lowered" position when access to equipment 15 is required. Lowering is accomplished by lifting housing 4 slightly so as to dislodge knob 23 from brace 26 and then allowing the assembly 8 to swing freely to a lowered position. If even freer access to the underside of table top 11 is required, the tray assembly a can be completely removed by swinging retaining tabs 9 to an open position and lifting the entire assembly from the upper support rod 5.

While the invention has been particularly shown and described with reference to preferred embodiments thereof, it will be understood by those skilled in the art that various changes in form and details may be made therein without departing from the spirit and scope of the invention. For example, the support leg 12 could extend straight down from the housing 4 so as to contact the ground, rather than extending between the housing 4 and the lower support rod 6.

The embodiments of the invention in which an exclusive property or privilege is claimed are defined as follows:

1. A sliding tray assembly for receiving documents fed by a document processing means, comprising:

a receiving bin for receiving documents from said document processing means;

a housing comprising a rigid frame and a slide means attached thereto;

a bin tray for supporting said receiving bin, said bin tray being slidably attached to said housing by said slide means, said slide means being operable to allow said bin tray to be recessed into said housing; and, an upper support member extending below said document processing means for supporting said housing at a first location on said housing;

2. The tray assembly according to claim 1, further comprising a support leg attached to the underside of said housing for supporting said housing at a second location.

3. The tray assembly according to claim 2, wherein said support leg extends between said second location on said housing and a lower support member, said lower support member extending below said upper support member in a direction generally perpendicular to said upper support member.

4. The tray assembly according to claim 1, wherein said housing is removably attached to said upper support member by means of at least one notch in said housing, said notch being shaped so as to accept said upper support member.

5. The tray assembly according to claim 4, wherein said housing is retained in position on said upper support member by at least one retaining tab mounted to said housing.

6. A tray assembly for receiving documents fed by a document processing means, comprising:

a receiving bin for receiving documents from said document processing means;

a housing comprising a rigid frame;

a bin tray attached to said housing for supporting said receiving bin;

an upper support member extending below said document processing means in a direction substantially perpendicular to a feeding direction of said documents for supporting said housing at a first location on said housing; and a support leg attached to the underside of said housing for providing support at a second location on said housing.

7. The tray assembly according to claim 6, wherein said housing is removably attached to said upper support member.

8. The tray assembly according to claim 7, further comprising at least one retaining tab on said housing for retaining said housing on said upper support.

9. The tray assembly according to claim 6, wherein said housing is rotatably attached to said upper support so as to allow said housing to be lowered to a stored position.

10. A slidable, lowerable, and removable tray assembly for receiving documents fed by a document processing means, said tray assembly comprising:

a receiving bin for receiving documents from said document processing means;

a housing comprising a rigid frame and a slide means attached thereto;

a bin tray for supporting said receiving bin, said bin tray being slidably attached to said housing by said slide means, said slide means being operable to allow said bin tray to be recessed into said housing.

an upper support member extending below said document processing means in a direction perpendicular to a feeding direction of said documents for supporting a housing at a first location on said housing, said housing being rotatably and removably attached to said upper support member so as to allow said housing to be lowered or removed; and a support leg attached to the underside of said housing for providing support at a second location on said housing.

11. The tray assembly according to claim 10, wherein said support leg extends between said second location on said housing and a lower support member extending below said upper support member in a direction generally perpendicular to said upper support member.

12. A machine for processing flat documents, comprising:

a document processing means;

a diverter table for accepting said flat documents;

a slidable, lowerable, and removable tray assembly for receiving documents fed by said diverter table, said tray assembly further comprising:

a receiving bin for receiving documents from said document processing means;

a housing comprising a rigid frame and a slide means attached thereto;

a bin tray for supporting said receiving bin, said bin tray being slidably attached to said housing by said slide means, said slide means being operable to allow said bin tray to be recessed into said housing.

an upper support member extending below said document processing means in a direction perpendicular to a feeding direction of said documents for supporting a housing at a first location on said housing, said housing being rotatably and removably attached to said upper support member so as to allow said housing to be lowered or removed; and a support leg attached to the underside of said housing for providing support at a second location on said housing.

13. The tray assembly according to claim 4 further comprising at least one retaining tab on said housing for retaining said housing on said upper support.

14. The tray assembly according to claim 6 wherein said support leg extends between said second location on said housing and a lower support member extending below said upper support member in a direction generally perpendicular to said upper support member.

* * * * *